US005171177A

United States Patent [19]

Hubbell

[11] Patent Number: 5,171,177

[45] Date of Patent: Dec. 15, 1992

[54] INTEGRALLY FORMED DRIVESHAFT HOUSING STRUCTURE FOR INTERPOSITION BETWEEN THE POWERHEAD AND LOWER UNIT OF A MARINE PROPULSION SYSTEM

[75] Inventor: James C. Hubbell, Fond du Lac, Wis.

[73] Assignee: Brunswick Corporation, Skokie, Ill.

[21] Appl. No.: 722,603

[22] Filed: Jun. 27, 1991

[51] Int. Cl.[5] ..... B63H 21/24

[52] U.S. Cl. ..... 440/78; 440/89

[58] Field of Search ..... 440/76, 78, 89, 113, 440/900; 123/195 P; 164/255

[56] References Cited

U.S. PATENT DOCUMENTS

| | | | |
|---|---|---|---|
| 2,209,301 | 7/1940 | Johnson et al. | 123/195 P |
| 2,549,479 | 4/1951 | Kiekhaefer . | |
| 2,609,782 | 9/1952 | Kiekhaefer | 440/78 |
| 4,033,282 | 7/1977 | Pichl | 440/78 |
| 4,906,214 | 3/1990 | Towner | 440/76 |

OTHER PUBLICATIONS

Pages 22, 23, 30, 31 and 34–37 of Quichsilver Parts Catalog for 220hp V6 Engines, Sep., 1987, published by Mercury Marine Division of Brunswick Corporation.

*Primary Examiner*—Jesus D. Sotelo

*Attorney, Agent, or Firm*—Andrus, Sceales, Starke & Sawall

[57] ABSTRACT

A driveshaft housing structure adapted for interposition between the powerhead and the gearcase of an outboard marine propulsion system. The driveshaft housing structure is integrally formed, and provides a driveshaft passage, a cooling water intake conduit arrangement, an exhaust discharge passage, a cooling water discharge passage, and an exhaust idler relief system. The listed components are formed of a series of walls which comprise a part of the integrally formed driveshaft housing structure, to provide a unitary one-piece cast structure eliminating the need to assemble an adaptor plate to the upper end of a driveshaft housing, as in the prior art. The unitary one-piece structure is constructed from lost foam casting of an assembled pattern which allows the various components to be integrally formed with each other.

21 Claims, 3 Drawing Sheets

INTEGRALLY FORMED DRIVESHAFT HOUSING STRUCTURE FOR INTERPOSITION BETWEEN THE POWERHEAD AND LOWER UNIT OF A MARINE PROPULSION SYSTEM

BACKGROUND AND SUMMARY

This invention relates to a marine propulsion system, and more particularly to a driveshaft housing structure for interposition between the powerhead and lower unit of an outboard marine propulsion system.

An outboard marine propulsion system generally includes a powerhead for providing rotary power to a driveshaft. The driveshaft provides rotary power to a gearcase, or lower unit, within which a propeller shaft is mounted. A propeller is fixed to the propeller shaft, and a reversing transmission is provided in the gearcase for driving the propeller, through the propeller shaft, in either a forward or reverse direction.

A driveshaft housing is located between the powerhead and the gearcase. In the prior art, an adaptor plate is mounted to the upper end of the driveshaft housing, and the powerhead is mounted to the upper surface of the adaptor plate. The adaptor plate must be physically secured to the upper end of the driveshaft housing, such as by bolts or the like, and a gasket is located between the driveshaft housing and the adaptor plate to provide a water-tight seal. As can be appreciated, this construction entails several separate components which must be assembled together.

The present invention has as its object to provide a unitary one-piece structure for interposition between the powerhead and the gearcase of an outboard marine propulsion system. It is a further object of the invention to provide a unitary one-piece structure which includes a passage for accommodating the driveshaft, an exhaust passage for routing exhaust downwardly from the powerhead, a cooling water intake conduit for passing cooling water upwardly from the gearcase toward the powerhead, and an idle exhaust relief system for discharging exhaust during idle operation of the engine.

The invention is employed in a marine propulsion system including a powerhead and a gearcase, with the powerhead including an internal combustion engine having a rotatable output member, a cooling water inlet and an exhaust discharge. The gearcase includes a housing, a propeller rotatably mounted to the housing, and a rotatable power transfer arrangement disposed within the housing and interconnected with the propeller. A driveshaft is interposed between the rotatable engine output member and the gearcase power transfer arrangement for rotatably driving the propeller in response to operation of the engine.

The invention broadly provides an integral one-piece structure adapted for interposition between the powerhead and the gearcase, and includes an upper horizontal mounting surface to which the powerhead is mounted. An exhaust opening is formed in the upper horizontal surface, and is in communication with the engine exhaust discharge. The gearcase is mounted to a lower substantially horizontal mounting surface, and an external housing extends between the upper and lower horizontal mounting surfaces. The housing includes walls defining a longitudinally extending internal cavity. First closed wall structure is located within the internal cavity, and defines a downwardly extending exhaust passage in communication with the upper surface exhaust opening. Second closed wall structure is located within the internal cavity, and defines a substantially vertical driveshaft passage extending between the upper surface and the lower surface, to accommodate the driveshaft.

In accordance with one aspect of the invention, an idle exhaust relief system is located within the internal cavity below the upper horizontal mounting surface. The idle exhaust relief system includes at least one enclosed chamber, with the upper extent of the chamber being defined in part by one or more walls extending transverse to the longitudinal axis of the internal cavity. An idle exhaust discharge outlet is formed in one of the housing walls in communication with the exhaust idle relief chamber, and an idle exhaust passage is formed in the first closed wall structure to discharge exhaust into the chamber during idle operation of the engine. The upper surface, the lower surface, the housing, the first and second closed wall structures and the transverse walls defining the upper extent of the idle exhaust relief chamber comprise a unitary integrally formed structure. In a preferred embodiment a pair of idle exhaust relief chambers are provided below the upper horizontal mounting surface. The upper extent of one of the chambers is defined by a portion of the first closed wall structure which extends transverse to the longitudinal axis of the internal cavity, to define a bend in the exhaust passage. The upper extent of the second idle exhaust chamber is defined by a horizontal wall located below the upper horizontal mounting surface.

In accordance with another aspect of the invention, a cooling water tube is located within the internal cavity for routing cooling water upwardly toward the powerhead. The upper surface, the lower surface, the housing, the first and second closed wall structures, and the cooling water tube comprise a unitary integrally formed structure. A cooling water supply cavity opens onto the upper horizontal mounting surface, and is in communication with the engine cooling water inlet, and the cooling water tube supplies cooling water to the cooling water supply cavity. A cooling water chamber is interposed between the cooling water cavity and the discharge of the cooling water tube. The cooling water chamber is defined in part by a pair of spaced walls oriented transverse to the longitudinal axis of the internal cavity, and a passage is formed in an upper one of the spaced walls to establish communication between the cooling water chamber and the cooling water supply cavity. In a preferred embodiment, a portion of the first wall structure defines a wall of either or both the cooling water supply cavity and the cooling water chamber.

In accordance with another aspect of the invention, the downwardly extending exhaust passage, which is defined by the first closed wall structure located within the internal cavity, extends between the upper surface exhaust opening and an exhaust discharge opening formed in the lower surface. The exhaust passage includes a bend between the upper surface exhaust opening and the lower surface exhaust discharge opening. The upper surface, the lower surface, the housing, and the first and second closed wall structures comprise a unitary integrally formed structure. A third wall structure defines a water discharge passage for routing cooling water discharged from the engine downwardly through the internal cavity and into the gearcase, and includes an inlet for receiving cooling water from the internal cavity. The third wall structure comprises a part of the unitary integrally formed structure. A lower portion of the first closed wall structure defines a substantially vertical lower portion of the exhaust passage, and the lower portion of the exhaust passage communicates through the bend with an upper angled portion which extends along an axis non-parallel to the vertical lower portion. The inlet to the water discharge passage faces upwardly, and the upper portion of the first closed wall structure is located in vertical alignment with the inlet to the water discharge passage. Cooling water discharged from the engine is collected in the internal cavity so as to at least partially surround the lower portion of the first closed wall structure, to cool the first closed wall structure. A gap is provided between at least a portion of the first closed wall structure and the third closed wall structure, so that water collected within the internal cavity contacts the first wall structure at the gap. A portion of the third wall structure is preferably defined by a wall of the external housing.

In a particularly preferred form of the invention, the above-noted aspects of the invention are combined into a single structure, to provide a particularly advantageous internal arrangement to the unitary one-piece structure.

The invention further contemplates a method of making a driveshaft housing structure for interposition between the powerhead and gearcase of a marine propulsion system, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
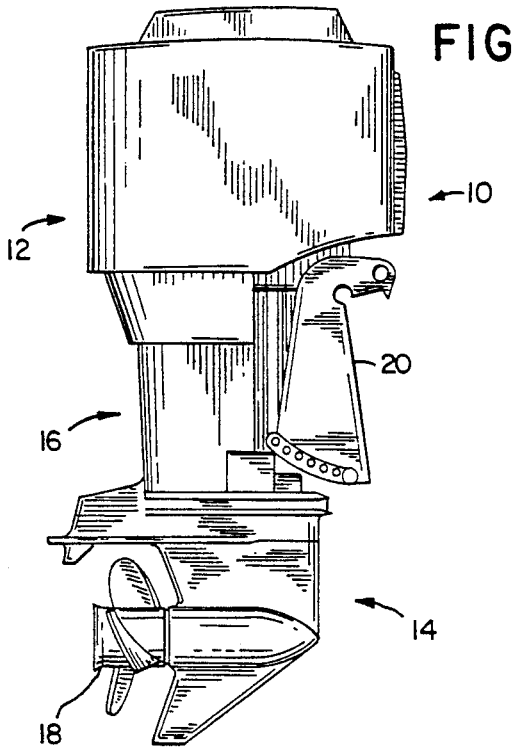
FIG. 1 is a side elevation view of an outboard marine propulsion system incorporating the unitary one-piece driveshaft housing structure of the invention.

Referring to FIG. 1, an outboard marine propulsion system 10 generally includes a powerhead enclosed by a cowl assembly 12, in combination with a gearcase 14 and a driveshaft housing structure 16 interposed between the powerhead and gearcase 14. In accordance with known construction, the powerhead enclosed by cowl assembly 12 comprises an internal combustion engine, typically a two-stroke cycle engine, providing a rotatable output member driven in response to operation of the engine. A propeller 18 is mounted to a propeller shaft rotatably mounted within gearcase 14, and a driveshaft extends downwardly from the powerhead and is drivingly engaged with the propeller shaft, to provide rotation of propeller 18 in response to operation of the engine.

A transom mounting bracket 20 is assembled to the upper portion of driveshaft housing structure 16, for pivotably mounting outboard system 10 to the transom of a boat, as is known.

Figure 3:
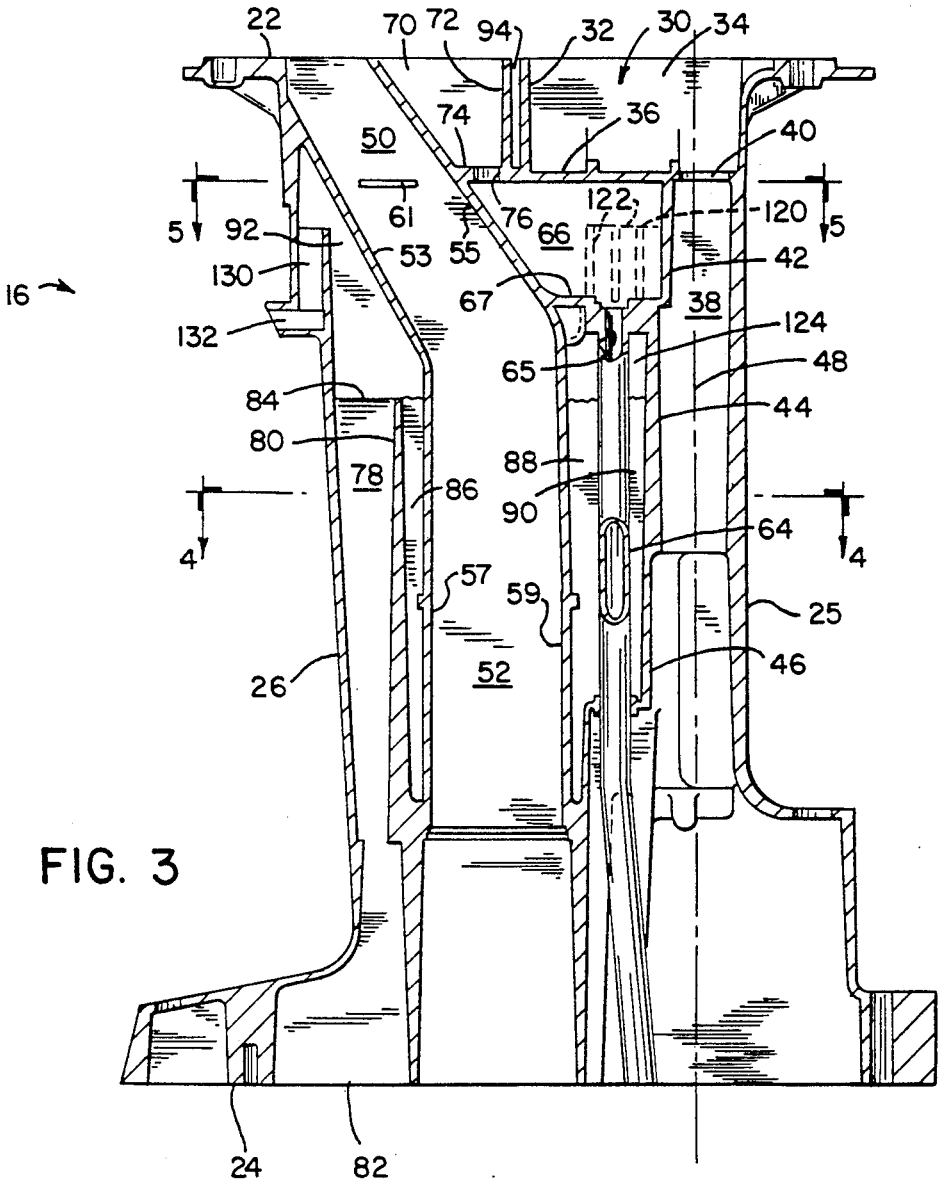
FIG. 3 is a longitudinal section view through an integral one-piece driveshaft housing structure constructed according to the invention.

Reference is now made to FIG. 3, which illustrates driveshaft housing structure 16 in section. Driveshaft housing structure 16 generally includes an upper substantially horizontal surface 22, and a lower substantially horizontal mounting surface 24. A housing, which includes a front wall 25, a rear wall 26, and a pair of side walls 27, 28 (FIGS. 4, 5) extending therebetween, extends between and interconnects upper surface 22 and lower surface 24. The housing formed by walls 25–28 defines a longitudinally extending internal cavity, within which the components described hereafter are located.

The internal combustion engine of the powerhead is mounted to upper surface 22, in a manner as is known. Upper surface 22, and the portion of driveshaft housing structure 16 located immediately therebelow act in a manner similar to a prior art adaptor plate, providing an engine mounting surface and a series of passages to accommodate engine exhaust and cooling water.

Gearcase 14 is connected by bolts or the like to lower horizontal mounting surface 24 of driveshaft housing structure 16.

An engine mount pocket, shown at 30, opens, onto upper horizontal surface 22. As is known, pocket 30 is adapted to receive engine mounts, interconnected with transom mounting bracket 20. Pocket 30 is defined by a rear wall 32, a pair of spaced side walls, one of which is shown at 34, a lower horizontal wall 36, and the upper portion of driveshaft housing structure front wall 25.

A driveshaft passage 38 extends downwardly from the front end of engine mount pocket 30, with an opening 40 in lower wall 36 establishing communication between engine mount pocket 30 and driveshaft passage 38. Driveshaft passage 38 is defined by front wall 25 of driveshaft housing structure, in combination with vertical rear walls, shown at 42, 44 and 46. Driveshaft passage 38 accommodates placement of a driveshaft extending between upper surface 22 and lower surface 24 of driveshaft housing structure 16. The driveshaft longitudinal axis is shown at 48. The driveshaft, extending along longitudinal axis 48, transfers rotary power from the engine output member to gearcase 14, in a manner as is known.

Figure 4:
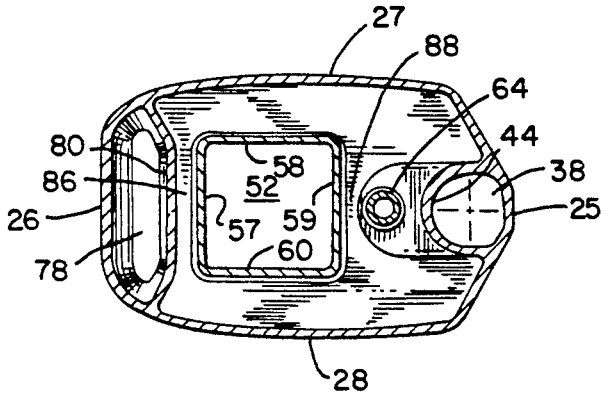
FIG. 4 is a section view taken generally along line 4—4 of FIG. 3.
Figure 5:
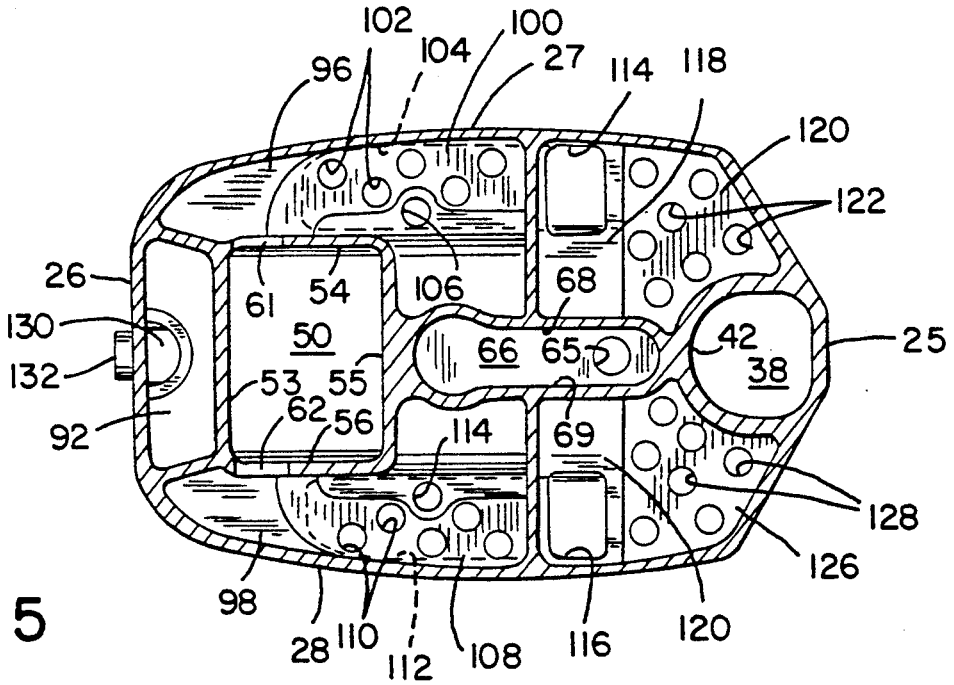
FIG. 5 is a section view taken generally along line 5—5 of FIG. 3.

The powerhead discharges exhaust through an exhaust discharge outlet, and in a typical arrangement for mounting a powerhead, an exhaust plate is provided below the powerhead, including exhaust passages in communication with the engine exhaust outlet. In accordance with the invention, the exhaust plate is mounted to upper surface 22 of driveshaft housing structure 16, and an engine exhaust passage, consisting of an upper angled portion 50 and a lower vertical portion 52, is in communication with the exhaust passage formed in the exhaust plate for routing exhaust downwardly through driveshaft housing structure 16. The exhaust discharge passage is substantially tubular in construction, with upper angled portion 50 communicating with lower vertical portion 52 through a bend. Upper angled portion 50 is defined by a series of walls, which are shown at 52, 54, 55 and 56 (FIGS. 3, 5). In a similar manner, lower vertical portion 52 is defined by a series of walls, shown at 57, 58 and 60 (FIGS. 3, 4).

An idle exhaust discharge passages 61, 62 (FIGS. 3, 5) are formed in a pair of walls 54, 56, respectively, of upper angled portion 50.

Between the lower vertical portion 52 of the exhaust discharge passage and driveshaft passage 38, a cooling water intake tube 64 is located. Cooling water intake tube 64 defines an internal passage 65, and is interconnected at its lower end with the discharge side of a water pump, located in gearcase 14 in a manner as is known. In this manner, cooling water pumped by the water pump passes upwardly through cooling water tube passage 65 and is discharged into a cooling water chamber 66 through an opening formed in a lower wall 67 of chamber 66. Cooling water chamber 66 is further defined by vertical wall 42 of driveshaft passage 38, lower wall 36 of engine mount pocket 30, the lower portion of angled wall 55 of angled exhaust discharge portion 50, and a pair of side walls 68, 69 (FIG. 5).

A cooling water supply cavity 70 opens onto upper horizontal surface 22 of driveshaft housing structure 16. Cooling water supply cavity 70 is defined by a front wall 72, the upper portion of angled wall 55, a pair of spaced side walls, and a lower wall 74. An opening 76 is formed in lower wall 74, to establish communication between cooling water chamber 66 and cooling water supply cavity 70.

With the arrangement as described, cooling water is supplied through tube 64 to cooling water chamber 66, and through opening 76 to cooling water supply cavity 70. In accordance with known construction, the exhaust plate to which the powerhead engine is mounted includes a cooling water intake passage, which is in communication with cooling water supply cavity 70, to provide cooling water to the inlet of the engine cooling system.

The presence of cooling water within chamber 66 and supply cavity 70 provides cooling to wall 55 of upper angled portion 50 of the exhaust discharge passage.

A water discharge passage 78 is located rearwardly of lower vertical portion 52 of the exhaust discharge passage. Water discharge passage 78 is defined by rear wall 26, in combination with a wall 80 separated by a gap from rear wall 57 of lower vertical exhaust discharge passage portion 52. Water discharge passage 78 is provided for routing cooling water discharged from the powerhead engine downwardly through gearcase housing structure 16, through a water discharge outlet 82 and into gearcase 14 for ultimate return to the body of water in which marine propulsion system 10 is operating.

An upwardly facing inlet 84 is located at the upper end of water discharge passage 78 for receiving water from within the internal cavity defined by housing walls 25–28. With this arrangement, water is maintained within the internal housing cavity at a level substantially equal to the elevation of inlet 84 at the upper end of water discharge passage 78. This construction provides cooling of walls 57–60 of lower vertical exhaust discharge portion 52. The discharged cooling water is located in the spaces around the walls of lower vertical portion 52, such as shown at 86, 88 and 90.

Angled wall 53, which in part defines upper angled exhaust discharge portion 50, is located in vertical alignment with upwardly facing inlet 84 of cooling water discharge passage 78. Wall 53 is connected at its rear upper end to the inner surface of rear housing wall 28. A chamber 92 is defined between water discharge inlet 84 and angled wall 54.

Figure 2:
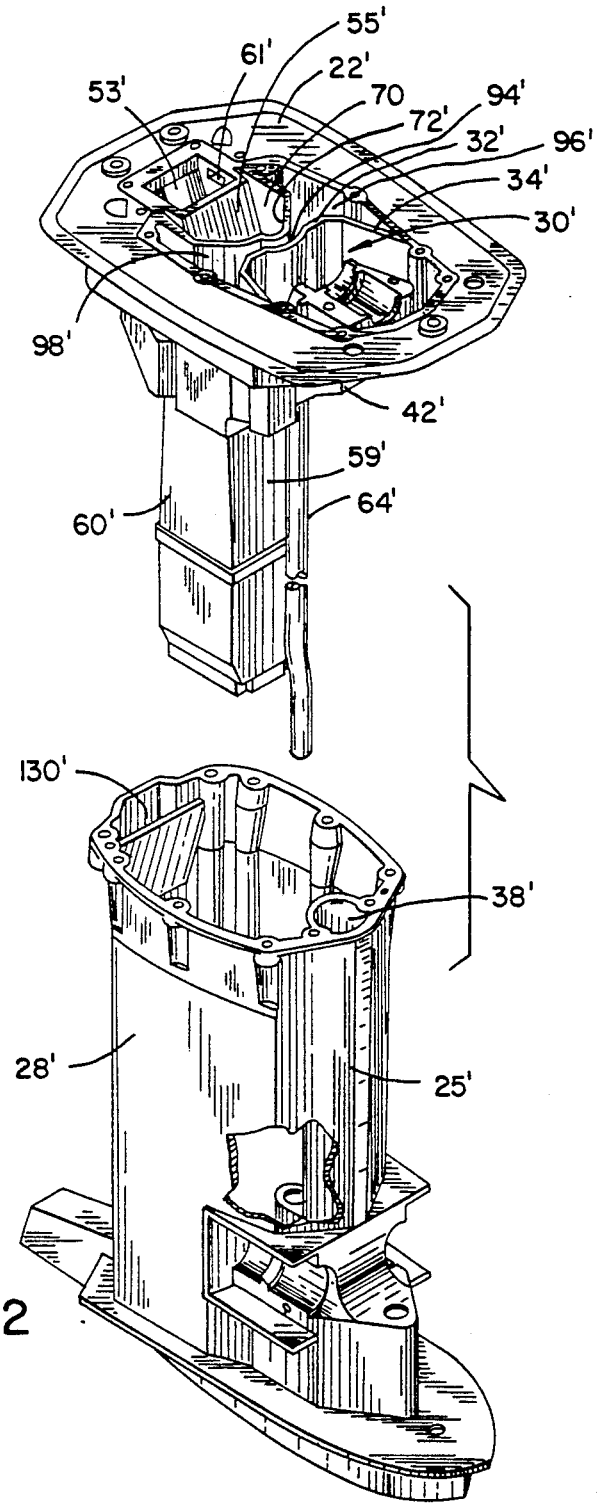
FIG. 2 is a perspective view of a pair of foam casting members, which are assembled together and employed in a lost foam casting process to yield the unitary one-piece driveshaft housing structure of the invention.

A water discharge opening, a portion of which is shown at 94 between vertical walls 32, 72 at the upper end of driveshaft housing structure 16, allows water discharged from the engine cooling system to fall over walls 54, 55 and 56 of exhaust discharge upper portion 50, and into the spaces, such as 86–90, around vertical exhaust discharge lower portion 52. FIG. 2, which shows the foam pattern components utilized in constructing driveshaft housing structure 16, illustrates water discharge passages 96', 98' on either side of passage 94', which corresponds to passage 94. The passages in driveshaft housing structure 16, which correspond to passages 96', 98' in the foam pattern, also provide such discharge of cooling water into the spaces, such as 86–90.

An exhaust idle relief system is provided below upper horizontal surface 22. As is known, during idle and low-speed operation, lower vertical exhaust discharge portion 52 will fill up with water, with the exhaust pressure above the water being insufficient to expel water therefrom through the below-water exhaust discharge associated with gearcase 14. When this occurs, exhaust passes through idle exhaust discharge openings 61 and 62, and into the idle exhaust relief system.

Referring to FIGS. 2 and 5, the exhaust idle relief system includes a pair of chambers 96, 98 located on opposite sides of exhaust discharge upper portion 50. Exhaust discharge through idle exhaust discharge openings 61, 61 during idle operation passes into chambers 96, 98, respectively. A surface 100 is provided above the floor of chamber 96, and a series of resonator passages 102 establish communication between chamber 96 and a passage, shown in dotted lines at 104, located below surface 100. A passage 106 extends through the floor of chamber 96 between a side of surface 100 and wall 54 of exhaust discharge upper portion 50, also establishing communication between chamber 96 and passage 104. Similarly, a surface 108 is provided above the floor of chamber 98, and resonator passages 110 establish communication between chamber 98 and a passage, shown in dotted lines at 112, located below surface 108. A passage 114 extends through the floor of chamber 98 between a side of surface 108 and wall 56 of exhaust discharge upper portion 50, also establishing communication between chamber 98 and passage 112.

Passages 104, 112, discharge through openings, shown at 114, 116, respectively, into resonator chambers 118, 120, respectively, located one on either side of cooling water chamber 66. A surface 120 is located above the floor of resonator chamber 118, and a series of resonator passages 122 establish communication between chamber 118 and an above-water space 124, which communicates around walls 57–60 of exhaust discharge lower portion 52 with chamber 92. Similarly, a surface 126 is located above the floor of resonator chamber 120, and a series of resonator passages 128 communicate between chamber 120 and above-water space 124.

A vertical idle exhaust passage 130 provides communication between chamber 92 and an exhaust discharge passage 132 formed in housing rear wall 28, to provide discharge of exhaust during idle operation. The tortuous or serpentine path defined by the idle exhaust relief system as shown and described provides attenuation of the engine noise when exhaust is discharged through the idle exhaust relief system.

All components illustrated in FIGS. 3-5 are formed integrally with each other in a lost foam casting process employing a pattern constructed from the two separate components illustrated in FIG. 2. FIG. 2 illustrates the pattern components corresponding to the components shown and described with respect to FIG. 3, with the pattern components being denoted with primed reference characters corresponding to the reference characters of FIGS. 3-5.

Various alternatives and embodiments are contemplated as being within the scope of the following claims particularly pointing out and distinctly claiming the subject matter regarded as the invention.

I claim:

1. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening;

second closed wall structure located within the internal cavity and defining a substantially vertical driveshaft passage extending between the upper surface and the lower surface to accommodate the driveshaft;

an exhaust idle relief system, including at least one exhaust idle relief chamber, located within the internal cavity below the upper horizontal mounting surface, wherein the upper extent of the exhaust idle relief chamber is defined in part by at least one walls extending transverse to the longitudinal axis of the internal cavity;

an exhaust idle discharge outlet formed in one of the housing walls in communication with the exhaust idle relief chamber; and an exhaust idle passage formed in the first closed wall structure for discharging exhaust into the exhaust idle relief chamber during idle operation of the marine propulsion system;

wherein the upper surface, the lower surface, the housing, the first and second closed wall structures and the transverse walls defining the upper extent of the exhaust idle relief chamber comprise a unitary integrally formed structure.

2. The structure of claim 1, wherein the engine includes a cooling water inlet and wherein a cooling water supply inlet opening is formed in the upper horizontal mounting surface, and further comprising cooling water conduit structure comprising a part of the unitary integrally formed structure for routing cooling water upwardly within the internal cavity toward the cooling water supply inlet.

3. The structure of claim 2, wherein the cooling water supply opening receives cooling water from a cooling water cavity formed below the upper horizontal surface, and wherein the cooling water conduit structure comprises a cooling water tube for supplying cooling water to the cooling water cavity.

4. The structure of claim 1, wherein the first closed wall structure includes a portion extending transverse to the longitudinal axis of the internal cavity to define a bend in the exhaust passage, and defining a portion of the upper extent of an exhaust idle relief chamber.

5. The structure of claim 1, wherein a portion of the upper extend of the exhaust idle relief chamber is defined by at least one transverse wall located below the upper horizontal mounting surface.

6. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the power head and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening;

second closed wall structure located within the internal cavity and defining a substantially vertical driveshaft passage extending between the upper surface and the lower surface to accommodate the driveshaft; and a cooling water tube located within the internal cavity for routing cooling water upwardly toward the powerhead;

wherein the upper surface, the lower surface, the housing, the first and second closed wall structures, and the cooling water tube comprise a unitary integrally formed structure, and wherein the cooling water tube is formed independently of the external housing, the first closed wall structure, and the second closed wall structure.

7. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening;

second closed wall structure located within the internal cavity and defining a substantially vertical driveshaft passage extending between the upper surface and the lower surface to accommodate the drive shaft;

a cooling water tube located within the internal cavity for routing cooling water upwardly toward the powerhead; and a cooling water supply cavity opening onto the upper horizontal mounting surface in communication with the engine cooling water inlet, wherein the cooling water tube supplies cooling water to the cooling water supply cavity;

wherein the upper surface, the lower surface, the housing, the first and second closed wall structures, and the cooling water tube comprise a unitary integrally formed structure.

8. The structure of claim 7, further comprising a cooling water chamber interposed between the cooling water supply cavity and the discharge of the cooling water tube, wherein the cooling water chamber is defined in part by a pair of spaced walls oriented transverse to the longitudinal axis of the internal cavity, and wherein a passage is formed in one of the spaced walls to establish communication between the cooling water chamber and the cooling water supply cavity.

9. The structure of claim 8, wherein a portion of the first wall structure defines a wall of one of the cooling water supply cavity or the cooling water chamber.

10. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening;

second closed wall structure located within the internal cavity and defining a substantially vertical driveshaft passage extending between the upper surface and the lower surface to accommodate the driveshaft;

a cooling water tube located within the internal cavity for routing cooling water upwardly toward the powerhead;

wherein the upper surface, the lower surface, the housing, the first and second closed wall structures, and the cooling water tube comprise a unitary integrally formed structure; and an exhaust idle relief system including at least one internal chamber located within the internal cavity below the upper horizontal mounting surface, wherein the upper extend of the internal idle relief chamber is defined in part by at least one wall extending transverse to the longitudinal axis of the internal cavity.

11. The structure of claim 10, further comprising a cooling water chamber for receiving cooling water from the discharge of the cooling water tube and supplying cooling water to the engine cooling water inlet, wherein the cooling water chamber is disposed between a pair of internal exhaust idle relief chambers.

12. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening, wherein the exhaust passage extends between the upper surface exhaust opening and an exhaust discharge opening formed in the lower surface, and wherein the exhaust passage defined by the first closed wall structure includes a bend between the upper surface exhaust opening and the lower surface exhaust discharge opening; and second closed wall structure located within the internal cavity and defining a substantially vertical driveshaft passage extending between the upper surface and the lower surface to accommodate the driveshaft;

wherein the upper surface, the lower surface, the housing and the first and second closed wall structures comprise a unitary integrally formed structure.

13. The structure of claim 12, further comprising a cooling water tube located within the internal cavity for routing cooling water upwardly toward the powerhead, wherein the cooling water tube comprises a part of the unitary integrally formed structure. includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening;

second closed wall structure located within the internal cavity and defining a substantially vertical driveshaft passage extending between the upper surface and the lower surface to accommodate the driveshaft;

a cooling water tube located within the internal cavity for routing cooling water upwardly toward the powerhead;

wherein the upper surface, the lower surface, the housing, the first and second closed wall structures, and the cooling water tube comprise a unitary integrally formed structure; and an exhaust idle relief system including at least one internal chamber located within the internal cavity below the upper horizontal mounting surface, wherein the upper extend of the internal idle relief chamber is defined in part by at least one wall extending transverse to the longitudinal axis of the internal cavity.

14. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening, wherein the exhaust passage extends between the upper surface exhaust opening and an exhaust discharge opening formed in the lower surface, and wherein the exhaust passage defined by the first closed wall structure includes a bend between the upper surface exhaust opening and the lower surface exhaust discharge opening;

second closed wall structure located within the internal cavity and defining a substantially vertical driveshaft passage extending between the upper surface and the lower surface to accommodate the driveshaft;

wherein the upper surface, the lower surface, the housing and the first and second closed wall structures comprise a unitary integrally formed structure;

a cooling water tube located within the internal cavity for routing cooling water upwardly toward the powerhead, wherein the cooling water tube comprises a part of the unitary integrally formed structure; and an internal chamber located within the internal cavity for receiving cooling water discharged from the cooling water tube, wherein a wall of the internal chamber is defined by the first wall structure.

15. In a marine propulsion system including a powerhead and a lower unit, wherein the powerhead includes an internal combustion engine having a rotatable output member, a cooling water inlet, and an exhaust discharge, and wherein the lower unit includes a housing, a propeller rotatably mounted to the housing, and a rotatable power transfer arrangement disposed within the housing and interconnected with the propeller, and further comprising a driveshaft interposed between the rotatable engine output member and the lower unit power transfer arrangement for rotatably driving the propeller in response to operation of the engine, the improvement comprising an integral unitary structure adapted for interposition between the powerhead and the lower unit, comprising:

an upper substantially horizontal mounting surface to which the powerhead is mounted, and including an exhaust opening in communication with the engine exhaust discharge;

a lower substantially horizontal mounting surface to which the lower unit is mounted;

an external housing extending between the upper and lower surfaces and including walls defining a longitudinally extending internal cavity;

first closed wall structure located within the internal cavity and defining a downwardly extending exhaust passage in communication with the upper surface exhaust opening, wherein the exhaust passage extends between the upper surface exhaust opening and an exhaust discharge opening formed in the lower surface, and wherein the exhaust passage defined by the first closed wall structure includes a bend between the upper surface exhaust opening and the lower surface exhaust discharge opening;

second closed wall structure located within the internal cavity and defining a substantially vertical driveshaft passage extending between the upper surface and the lower surface to accommodate the driveshaft; and third wall structure defining a water discharge passage for routing cooling water discharged from the engine downwardly through the internal cavity and into the lower unit, and including an inlet for receiving cooling water from the internal cavity;

wherein the upper surface, the lower surface, the housing and the first, second and third wall structures comprise a unitary integrally formed structure.

16. The structure of claim 15, wherein a lower portion of the first closed wall structure defines a substantially vertical lower portion of the exhaust passage, and wherein the substantially vertical lower portion of the exhaust passage communicates through the bend with an upper angled portion extending along an axis nonparallel to the substantially vertical lower portion and defined by an upper portion of the first closed wall structure.

17. The structure of claim 16, wherein the inlet to the water discharge passage faces upwardly, and wherein the upper portion of the first closed wall structure is located in vertical alignment with the inlet to the water discharge passage.

18. The structure of claim 16, wherein cooling water discharged from the engine is collected in the internal cavity so as to at least partially surround the lower portion of the first closed wall structure, to cool the first closed wall structure.

19. The structure of claim 18, wherein the first wall structure and the third wall structure overlap each other in a vertical direction, and are separated along a portion of their length by a gap, wherein water collected within the internal cavity contacts the first wall structure at the gap.

20. The structure of claim 15, wherein a portion of the third wall structure is defined by a wall of the external housing.

21. A method of making a driveshaft housing structure for interposition between the powerhead and the lower unit of a marine propulsion system, wherein the powerhead includes an internal combustion engine having a rotatable output member, a cooling water inlet, and an exhaust discharge; and wherein the lower unit includes a housing, a propeller rotatably mounted to the housing, and a rotatable power transfer arrangement disposed within the housing and interconnected with the propeller; and further comprising a driveshaft interposed between the rotatable engine output member and the lower unit power transfer arrangement for rotatably driving the propeller in response to operation of the engine, the method comprising:

integrally forming the driveshaft housing structure to include an upper horizontal powerhead mounting surface including an exhaust opening; a lower horizontal lower unit mounting surface; an external housing extending between the upper and lower surfaces and including walls defining a longitudinally extending internal cavity; a first closed wall structure defining a downwardly extending exhaust passage located within the internal cavity; a second closed wall structure defining a substantially vertical driveshaft passage located within the internal cavity adapted to receive the driveshaft; and an exhaust idle relief system including an exhaust idle relief chamber located within the internal cavity below the upper surface, wherein the upper extent of the exhaust idle relief chamber is defined by at least one wall extending transversely to the longitudinal axis of the internal cavity, wherein the transverse wall is formed below the upper horizontal surface;

forming an exhaust idle relief passage in the first closed wall structure to provide communication between the exhaust passage and the exhaust idle relief chamber; and forming an exhaust idle discharge outlet in one of the housing walls to provide discharge of exhaust during idle operation from the exhaust idle relief chamber exteriorly of the housing through the exhaust discharge outlet.

* * * * *

UNITED STATES PATENT AND TRADEMARK OFFICE

CERTIFICATE OF CORRECTION

PATENT NO. : 5,171,177

DATED : December 15, 1992

INVENTOR(S) : JAMES C. HUBBELL

It is certified that error appears in the above-identified patent and that said Letters Patent is hereby corrected as shown below:

IN THE CLAIMS

Claim 5, Col. 8, Line 19, delete "extend" and insert -- extent --; Claim 10, Col. 10, Line 29, delete "extend" and insert --extent--; Claim 13, Col. 11, Line 19-61, after "structure," delete "includes a...internal cavity."

Signed and Sealed this

Twenty-sixth Day of October, 1993

*Attest:*

Bruce Lehman

BRUCE LEHMAN

*Attesting Officer*

*Commissioner of Patents and Trademarks*